United States Patent [19]

Gray

[11] Patent Number: 4,494,309

[45] Date of Patent: Jan. 22, 1985

[54] EASY ACCESS KNIFE HOLDER

[75] Inventor: Robert A. Gray, Aiken, S.C.

[73] Assignee: Robert Alan Gray Ltd., Aiken, S.C.

[21] Appl. No.: 540,405

[22] Filed: Oct. 11, 1983

[51] Int. Cl.[3] ..... B26B 29/02

[52] U.S. Cl. ..... 30/151; 30/156; 224/232

[58] Field of Search ..... 224/903, 904, 163, 232; 30/151, 156

[56] References Cited

U.S. PATENT DOCUMENTS

| | | | |
|---|---|---|---|
| 1,028,008 | 5/1912 | Eslick | 30/151 X |
| 2,387,900 | 10/1945 | Hartwell | 224/242 |
| 2,447,915 | 8/1948 | Sisk | 224/904 X |
| 2,650,008 | 8/1953 | Morseth | 224/232 |
| 3,958,330 | 5/1976 | Hutchens | 30/151 |
| 4,326,652 | 4/1982 | Fortenberry | 30/151 |
| 4,389,775 | 6/1983 | Collins | 30/156 |

*Primary Examiner*—Jimmy C. Peters

[57] ABSTRACT

A holder for a knife is disclosed comprising a base, a rear portion, first and second side portions, and first and second flexible portions, with the first and second flexible portions forming the front portion of the first and second side portions and pressing inward to secure the knife within the holder, with the blade of the knife held in an open area between the first and second flexible portions for easy access and utilization.

8 Claims, 10 Drawing Figures

EASY ACCESS KNIFE HOLDER

This invention relates to a knife holder and more particularly to a knife holder which is self-securing.

There are many instances in which the owner of a knife would want to have the knife available for utilization as quickly and easily as possible. The present invention provides a self-securing knife holder which can be utilized with a legal knife to provide easy access for the user.

An object of the present invention is to provide a knife holder in which the knife is secured, but is easily accessible to the user.

Another object of the present invention is to provide a knife holder which provides for easy accessibility for right or left-handed utilization.

Still another object of the present invention is to provide a knife holder which holds a knife securely to prevent loss, while being easily accessible for instantaneous utilization.

A further object of the present invention is to provide a knife holder in which a knife can be instantaneously removed by one hand for utilization and convenience.

These and other objects and features of the invention will be apparent from the following description and appended claims.

Briefly, the invention is a holder for a knife. The knife comprises a blade secured within a knife handle. A base is sized and shaped to conform with the bottom of the knife. The bottom of the knife rests on the base. A rear portion is sized and shaped to conform with the back of the knife. The rear portion is secured to the base. The back of the knife may rest on the rear portion.

A first side portion is sized and shaped to conform with the first side of the knife handle. The first side portion is secured to the base and the rear portion. A second side portion is sized and shaped to conform with the second side of the knife handle. The second side portion is secured to the base and the rear portion.

A first flexible portion forming the first front portion of the first side portion is flexed inward toward the second side portion. A second flexible portion forming the second front portion of the second side portion is flexed inward toward the first side portion. The first flexible portion is separated from the second flexible portion by an open area. The first flexible portion and the second flexible portion are sized and shaped to press inward and to secure the knife within the holder. The first flexible portion presses inward onto the first front side of the first side of the knife handle. The second flexible portion presses inward onto the second front side of the second side of the knife handle. The first front of the first side of the knife handle and the second front of the second side of the knife handle are held within an open area by and between the first flexible portion and the second flexible portion of the holder. The blade is easily accessible and utilizable for removing the knife from the holder. Holding means is secured to the first side portion of the holder whereby the holder may be secured to a user of the knife.

Binding trim may be secured on the edges of the rear portion, the first side portion, and the second side portion of the holder. The binding trim may be secured to the front edge of the base.

The base, the rear portion, the front side portion, and the second side portion may be formed of an outer material, an inner rigid structural member, and an inner finishing material. The inner rigid structural member is secured within the outer finishing material. The inner finishing material is secured within the inner rigid structural member. The base, the rear portion, the first side portion, and the second side portion may be formed of a pre-formed, molded material.

The invention will be more fully understood from the following detailed description and appended claims when taken with the drawings in which:

Figure 7:
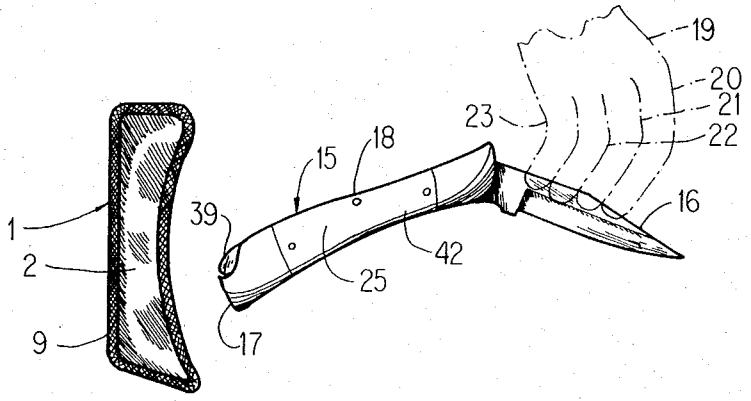

FIG. 7 is an elevational view of knife 15 after removal from knife holder 1, with knife blade 16 almost opened.

Figure 8:
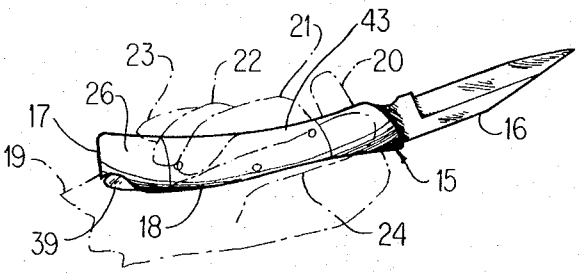

FIG. 8 is an elevational view of knife 15 in hand 19 ready for utilization.

Figures 1, 2, 3, 4, 9:
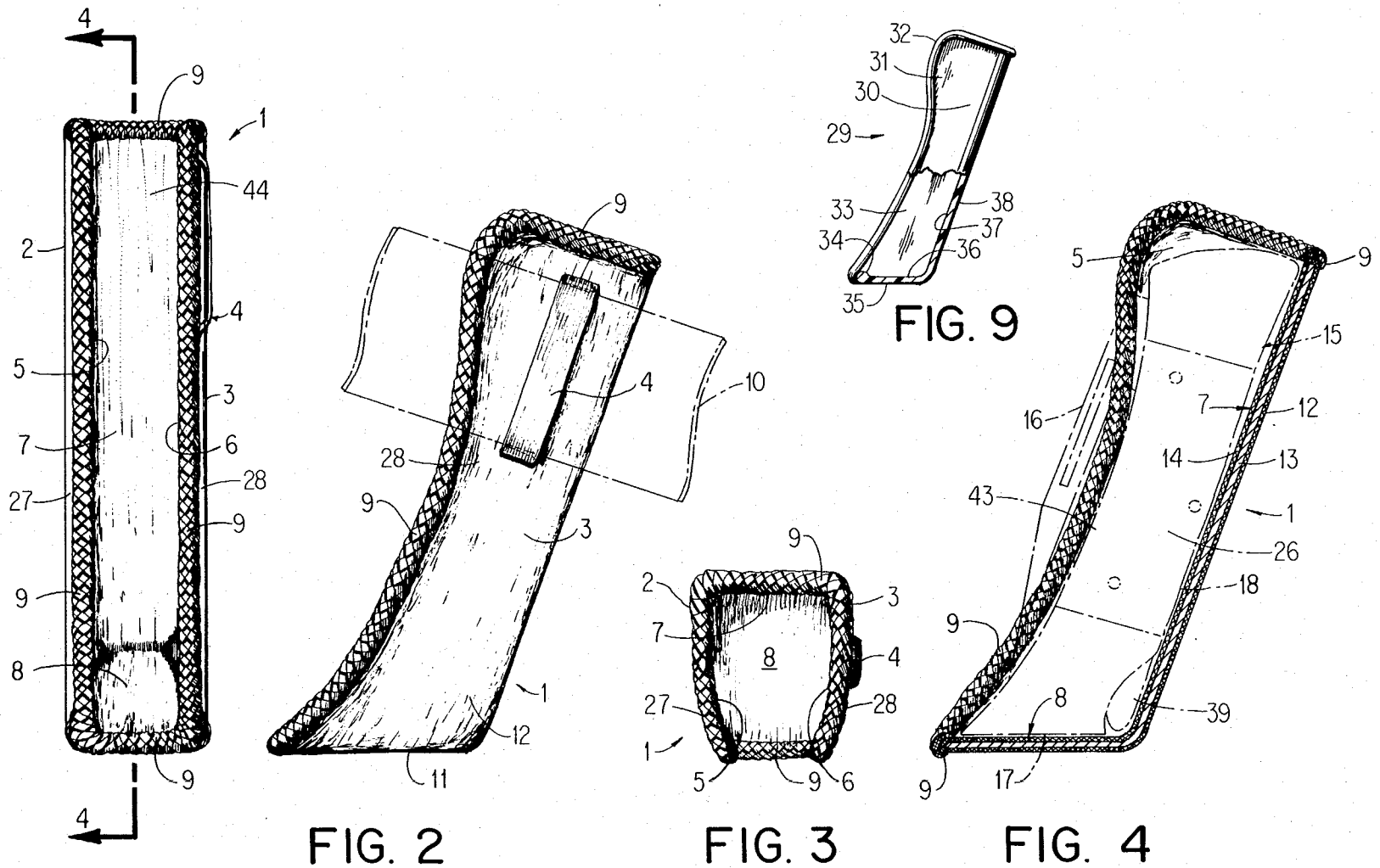
FIG. 1 is a front elevational view of knife holder 1.
FIG. 2 is a side elevational view of knife holder 1.
FIG. 3 is a top elevational view of knife holder 1.
FIG. 4 is a sectional view taken at section 4—4 of FIG. 1 additionally showing knife 15 in broken lines.

FIG. 9 is a partial sectional side elevational view of pre-formed knife holder 29.

Figure 10:
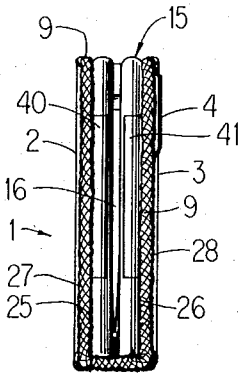

FIG. 10 is a front elevational view of knife 15 in knife holder 1.

Referring now to the drawings, FIG. 1 is a front elevational view of knife holder 1. Knife holder 1 comprises side portions 2 and 3 and an inner bottom surface 8. On side portion 3 is shown loop 4. Loop 4 may be utilized for the knife holder 1 to be secured to a belt or other holding means. Knife holder 1 serves the purpose of holding securely a knife.

Side portion 2 has a flexible portion 27. Side portion 3 has a flexible portion 28. Open area 44 is formed between flexible portion 27 and flexible portion 28. Flexible portion 27 of side portion 2 has an inner surface 5. Flexible portion 28 of side portion 3 has an inner surface 6. The rear portion of knife holder 1 has an inner surface 7. Knife holder 1 has a binding trim 9 which extends along the edges of the exterior portion of knife holder 1.

FIG. 2 is a side elevational view of knife holder 1. FIG. 2 shows a belt 10 fitting through loop 4 in order to secure the knife holder 1 to the user of the knife. Knife holder 1 has a bottom face 11. Binding trim 9 extends around the exterior edges of knife holder 1.

FIG. 3 is a top elevational view of knife holder 1. Side portion 2 has a flexible portion 27 with an inner surface 5. Side portion 3 has a flexible portion 28 with an inner surface 6. The knife is placed through the open area 44 between flexible portions 27 and 28. The flexible portions 27 and 28 flex outward to allow the knife to enter. After the knife enters, the flexible portions 27 and 28 flex back to secure the knife within knife holder 1.

The bottom of the knife would rest on the inner bottom surface 8 of knife holder 1. The back of the knife would rest against the inner surface 7 of the rear portion of knife holder 1. The sides of the knife (See FIG. 10) would rest against side portions 2 and 3 of knife holder 1. Flexible portion 27 of side portion 2 and flexible portion 28 of side portion 3 flex inward to secure the knife within the knife holder 1. The front of the blade (See FIG. 10) would appear at the open area 44 between the flexible portions 27 and 28.

The binding trim 9 fits around the edges of the knife holder 1 to fulfill several functions. The binding trim 9 performs a decorative function and a finishing function. The binding trim 9 forms a rim around the edges to further aid the functions of the knife holder 1 to grip and hold the knife within the knife holder 1. The binding trim 9 also serves as protection for the various portions of the knife holder 1 and gives longer life and better service for the knife holder 1.

FIG. 4 is a sectional view taken at section 4—4 of FIG. 1. FIG. 4 shows knife 15 within knife holder 1. Knife blade 16 extends outward from the knife holder 1 where it is accessible to the knife user. The knife holder 1 is shaped for the particular knife 15 being held within. The knife holder 1 may be different sizes and shapes depending on the desired knife 16 to be held. The knife holder 1 is designed so that the knife blade 16 extends outward from the knife holder 1 for easy accessibility.

The knife 15 has a knife blade 16 which extends outward from the knife holder 1. The knife 15 has a knife base 17 which rests on inner bottom surface 8 of knife holder 1. Knife 15 has a back rib 18 which rests against the inner surface 7 of the rear portion of knife holder 1. Knife 15 has knife handle side 26 and knife handle side 25 (not shown). Knife handle side 26 has a front side portion 43. Knife 15 has a knife release 39.

The knife holder 1 comprises an outer finishing material 12 which may be leather. The knife holder 1 has an inner rigid structural member 13 which may be some form of metal to rigidly shape the knife holder 1. The knife holder 1 may have an inner finishing material 14 which forms the inner surface of the knife holder 1. The inner rigid structural member 13 is appropriately shaped for the desired knife 15 to be utilized. The flexible portions 27 and 28 are pre-formed by the shaped of the inner rigid structural member 13.

Figure 5:
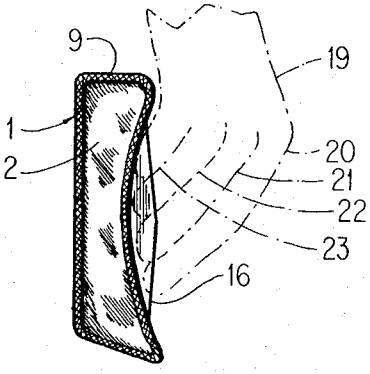
FIG. 5 is an elevational view showing blade 16 extending from knife holder 1.

FIG. 5 is an elevational view showing blade 16 extending from knife holder 1. The hand 19 of the user of the knife holder 1 is shown. Hand 19 has fingers 20, 21, 22, and 23 and thumb 24 (see FIG. 8). The knife bland 16 is openly extending from the knife holder 1. The hand 19, with fingers 20, 21, 22, and 23 and thumb 24 (see FIG. 8), grasps the knife blade 16 in order to remove the knife from the knife holder 1.

Figure 6:
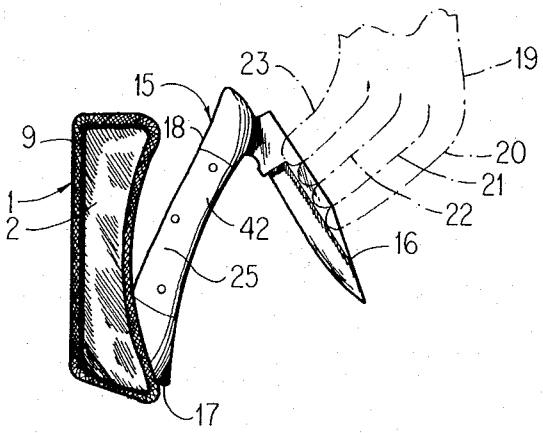
FIG. 6 is an elevational view of knife 15 being partially removed from knife holder 1.

FIG. 6 is an elevational view of knife 15 being partially removed from knife holder 1. The knife base 17 is still resting partially within the inner bottom surface 8 of knife holder 1. The knife 15 has a knife handle with knife handle sides 25 and 26 (see FIG. 8) for securing knife blade 16 within the knife 15. Knife handle side 25 is shown in FIG. 6 almost removed from the knife holder 1. Knife blade 16 is partially opened. The knife 15 is being removed strictly by the outward movement of the knife blade 16 within hand 19. Knife handle side 25 has a front side portion 42.

FIG. 7 is an elevational view of knife 15 after removal from knife holder 1, with knife blade 16 almost opened. The knife base 17, knife release 39, and the knife handle side 25 are shown completely clear of the knife holder 1. The action of the removal of knife 15 from knife holder 1 will pull the knife blade 16 completely open.

FIG. 8 is an elevational view of knife 15 in hand 19 ready for utilization. As the knife blade 16 is pulled completely out, as shown in FIG. 7, the hand 19 is ready to flip under the knife handle sides 26 and 25 (not shown) and back rib 18. The knife 15 is then properly held by hand 19 for utilization. FIGS. 5, 6, 7, and 8 are a series of figures showing various stop-action positions in the removal of knife 15 from knife holder 1.

In essense, the hand 19 grasps the knife blade 16, pulling it straight out. As the knife blade 16 fully opens, the hand 19 flips over in order to grasp the knife handle sides 25 and 26 and the back rib 18 in order for the knife 15 to be utilized.

The flexible portions 27 and 28 hold the knife 15 within the knife holder 1 until the user desires use of knife 15. When the user makes that decision, an efficient, quick pull on knife blade 16 will produce the knife 15 in a position for utilization as illustrated herein. When the knife 15 has been utilized, knife release 39 may be pressed to return the knife blade 16 into the proper position between knife handles 25 (See FIG. 7) and 26, and the knife 15 may be re-placed within knife holder 1.

FIG. 9 is a partial sectional side elevational view of pre-formed knife holder 29. Pre-formed knife holder 29 may be made from any desired product, including plastic. FIGS. 1–8 and FIG. 10 show a knife holder 1 which has an inner rigid structural member 13 with an inner finishing material 14 and an inner finishing material 12. FIG. 9 illustrates that a pre-formed knife holder 29 can be made, utilizing the principles of this invention, out of a flexible material, such as plastic.

Pre-formed knife holder 29 has a side potion 30 with a flexible portion 31. Pre-formed knife holder 29 also has another side portion (not shown) with another flexible portion (not shown). A ribbed edge 32 is shown extending along the exterior edges of the pre-formed knife holder 29. Pre-formed knife holder 29 has a bottom portion 35 with an inner surface 36 and a back portion 38 with an inner surface 37. The pre-formed knife holder 29 works similarly to knife holder 1, the only difference being the structural materials utilized therein.

In the pre-formed knife holder 29, the inner rigid structural member 13 with an outer finishing material 12 and inner finishing material 14 are re-placed by a pre-formed knife holder 29 which is molded together.

Side portion 30 is shown having an inner surface 33. The side portion (not shown) would also have an inner surface (not shown). A ribbed lower edge 34 is shown connected to the ribbed edge 32. Ribbed edge 32 extends along the edges of the side portion 32 and the side portion (not shown) and the back portion (not shown).

FIG. 10 is a front elevational view of knife 15 in knife holder 1. The knife 15 comprises a knife blade 16 secured within a knife handle. The knife handle has a first handle side 25 and a second handle side 26. The side portion 2 of knife holder 1 is sized and shaped to conform with knife handle side 25. Side portion 3 of knife holder 1 is sized and shaped to conform with knife handle side 26. The flexible portion 27 of side portion 2 and the flexible portion 28 of side portion 3 press inward to secure the knife 15 within knife holder 1. The flexible portion 27 presses inward on the front side 42 of knife handle side 25. The flexible portion 28 presses inward on the front side 43 of knife handle side 26. The knife blade 16 is held within an open area by and between flexible portion 27 and flexible portion 28. The front 40 of the knife handle side 25 and the front 41 of the knife handle side 26 are held, along with knife blade 16, by and between flexible portions 27 and 28.

Knife holder 1 or pre-formed knife holder 29 carry knife 15 in an easily accessible position. The knife holders 1 and 29 give the fastest and safest possible access to open and have ready for utilization a knife that is legal and safe to carry. Knife holder 1 or pre-formed knife holder 29 may have any type holding means which secures one of the side portions of the knife holder to the user of the knife 15. Any type holding means may secure the knife 15 in the knife holder 1 or 29 to the user.

The knife 15 can be removed with one hand. No snaps are utilized. The knife holders 1 or 29 may be designed to fit all knife designs made by various manufacturers. Utilizing the principles of the present invention, knife 15 is automatically opened. Because of the self-securing aspects of the present invention, the knife 15 remains within the knife holder 1 or 29. Instantaneous access is available to the user. The knife holder 1 or the pre-formed knife holder 29 is convenient, aesthetically pleasing, and unique. The knife holders 1 and 29 have many advantages. The knife 15 does not have to be kept in the pocket of the user. The knife holders 1 or 29 may be made with loop 4 on either side portion of the knife holders and can be adaptable for right or left-handed use. Because of the self-securing aspects of the present invention, the knife 15 will not be accidentally dislodged by the user brushing against various objects, such as trees, buildings, persons, automobiles, etc. The invention provides a knife holder which holds a knife securely to prevent loss, while being easily accessible for instantaneous utilization by only one hand of the user.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A holder for a knife comprising a blade secured within a knife handle comprising:

a. a base, sized and shaped to confrom with the bottom of said knife, upon which said bottom of said knife rests;

b. a rear portion, sized and shaped to conform with the back of said knife, secured to said base upon which said back of said knife may rest;

c. a first side portion, sized and shaped to conform with the first side of said knife handle, said first side portion secured to said base and said rear portion;

d. a second side portion, sized and shaped to conform with the second side of said knife handle, said second side portion secured to said base and said rear portion;

e. a first flexible portion forming the first front portion of said first side portion, flexed inward toward said second side portion; and f. a second flexible portion forming the second front portion of said second side portion, flexed inward toward said first side portion, and separated from said first flexible portion by an open area, whereby said first flexible portion and said second flexible portion are sized and shaped to press inward and to secure said knife within said holder, said first flexible portion pressing inward onto the first front side of said first side of said knife handle and said second flexible portion pressing inward onto the second front side of said second side of said knife handle, whereby said blade, the first front of said first side of said knife handle, and the second front of said second side of said knife handle are held within said open area by and between said first flexible portion and said second flexible portion of said holder, said blade easily accessible and utilizable for removing said knife from said holder.

2. A holder according to claim 1 further comprising holding means secured to said first side portion of said holder whereby said holder may be secured to a user of said knife.

3. A holder according to claim 1 further comprising binding trim secured on the edges of said rear portion, said first side portion, and said second side portion.

4. A holder according to claim 3 wherein said binding trim is further secured on the front edge of said base.

5. A holder according to claim 1 wherein said base, said rear portion, said first side portion, and said second side portion are formed of an outer finishing material, an inner rigid structural member secured within said outer finishing material, and an inner finishing material secured within said inner rigid structural member.

6. A holder according to claim 1 wherein said base, said rear portion, said first side portion, and said second side portion are formed of a pre-formed, molded material.

7. A holder according to claim 5 further comprising holding means secured to said first side portion of said holder whereby said holder may be secured to a user of said knife.

8. A holder according to claim 6 further comprising holding means secured to said first side portion of said holder whereby said holder may be secured to a user of said knife.

* * * * *